US010315065B1

(12) United States Patent
Soba

(10) Patent No.: US 10,315,065 B1
(45) **Date of Patent: *Jun. 11, 2019**

(54) YOGA AND EXERCISE MAT WITH ATTACHABLE MARKERS

(71) Applicant: Taino Soba, Brooklyn, NY (US)

(72) Inventor: Taino Soba, Brooklyn, NY (US)

( * ) Notice: Subject to any disclaimer, the term of this patent is extended or adjusted under 35 U.S.C. 154(b) by 721 days.

This patent is subject to a terminal disclaimer.

(21) Appl. No.: 14/936,176

(22) Filed: Nov. 9, 2015

Related U.S. Application Data

(63) Continuation-in-part of application No. 14/280,061, filed on May 16, 2014, now Pat. No. 9,211,437.

(51) Int. Cl.

| | |
|---|---|
| ***A47G 9/06*** | (2006.01) |
| ***A63B 1/00*** | (2006.01) |
| ***A63B 26/00*** | (2006.01) |
| ***A63B 21/04*** | (2006.01) |
| ***A63B 21/00*** | (2006.01) |
| ***E04F 15/22*** | (2006.01) |

(52) U.S. Cl.
CPC ..... *A63B 21/4037* (2015.10); *E04F 15/22* (2013.01); *A47G 9/06* (2013.01); *A63B 26/00* (2013.01)

(58) Field of Classification Search
CPC ..... A63B 23/00; A63B 26/00; A63B 6/00; A63B 21/1473; A63B 1/00; A63B 21/04; E04F 15/22; A47G 9/06
USPC ..... 5/417, 420, 907; 482/23, 142
See application file for complete search history.

(56) References Cited

U.S. PATENT DOCUMENTS

| | | | | |
|---|---|---|---|---|
| 3,935,653 A | | 2/1976 | Klein | |
| 4,779,862 A | * | 10/1988 | Keppler | A63B 69/0022 482/51 |
| 5,133,700 A | * | 7/1992 | Braathen | A63B 69/0022 472/118 |
| 5,352,165 A | * | 10/1994 | Koblick | A63B 22/20 434/253 |
| 5,417,636 A | * | 5/1995 | Havens | A63B 21/0552 482/140 |

(Continued)

OTHER PUBLICATIONS

Introducing Stillmotion Yoga Mat, Sequence Yoga Brand, LLC (retrieved Jul. 2, 2014). http://sequenceyogabrand.com/products-page/.

(Continued)

*Primary Examiner* — Eric J Kurilla
*Assistant Examiner* — Rahib T Zaman
(74) *Attorney, Agent, or Firm* — Winston & Strawn LLP

(57) ABSTRACT

A novel yoga and exercise mat is provided, which has a plurality of attachable markers that can be securely affixed to the mat. Particularly the plurality of attachable markers are provided in an array of different shapes, styles and colors, wherein the colors easily contrast with the color of the mat, which further serves a major function of aiding those individuals who are visually impaired. The plurality of markers may also be personalized, whereby the exercising individual can print his/her own messages as a way of motivation with the ultimate end-goal of achieving enhanced exercise results by being able to establish proper alignment, correct form and posture on the mat during the performance of yoga, exercise, or any other physical activity, while at the same time greatly minimizing the risk of acquiring an injury.

13 Claims, 13 Drawing Sheets

(56) References Cited

U.S. PATENT DOCUMENTS 6,387,013 B1 * 5/2002 Marquez ..... A63B 6/00 473/278
6,663,537 B2 * 12/2003 McCoy ..... A47G 27/0418 482/14
6,935,382 B2 * 8/2005 Buckley ..... D03D 1/00 139/391
7,069,607 B2 * 7/2006 Nichols ..... 5/420
7,108,635 B2 * 9/2006 Howlett-Campanella ..... A63B 21/4037 482/23
7,485,071 B2 2/2009 Edwards
7,955,224 B2 * 6/2011 Curley ..... A63B 26/00 482/140
8,220,087 B2 7/2012 Villa et al.
8,439,810 B2 * 5/2013 Baudhuin ..... A63B 21/00 482/908
8,499,383 B1 * 8/2013 Ungaro ..... A63B 23/035 482/23
8,701,654 B2 4/2014 Newburger et al.
8,966,681 B2 * 3/2015 Burch ..... A63B 21/4037 482/23
2002/0142888 A1 * 10/2002 Marques ..... A63B 6/00 482/23
2003/0017915 A1 * 1/2003 Prinzmetal ..... A63B 6/00 482/23
2004/0214692 A1 * 10/2004 Koenig ..... A63B 21/4037 482/23
2004/0229731 A1 * 11/2004 Mitchell ..... A63B 6/00 482/23
2004/0250346 A1 * 12/2004 Vasishth ..... A47G 27/0237 5/417
2006/0040811 A1 * 2/2006 Foster ..... A63B 21/4037 482/142
2006/0073305 A1 * 4/2006 Kole ..... A63B 21/4037 428/80
2007/0066467 A1 * 3/2007 Edwards ..... A63B 21/4037 482/148
2007/0275827 A1 * 11/2007 Glaser ..... A63B 21/4037 482/23
2009/0181836 A1 * 7/2009 Schneider ..... A63B 6/00 482/140
2010/0299833 A1 * 12/2010 Kessler ..... A63B 21/4037 5/417
2010/0306917 A1 * 12/2010 Batiste ..... A47G 27/0237 5/420
2011/0072581 A1 * 3/2011 Villa ..... A63B 21/4037 5/420
2011/0111926 A1 * 5/2011 Goranson ..... A63B 6/00 482/23
2011/0131723 A1 * 6/2011 Andrews ..... A45F 3/14 5/417
2013/0035211 A1 * 2/2013 Abel ..... A63B 69/0057 482/51
2013/0180048 A1 * 7/2013 Saltzman ..... A63B 23/035 5/417
2013/0324382 A1 * 12/2013 Wilson ..... A61H 7/007 482/142
2015/0367158 A1 * 12/2015 Pretz ..... A63B 21/0442 482/129
2016/0067540 A1 * 3/2016 Dill ..... A63B 21/0557 482/129

OTHER PUBLICATIONS (Audio—not a reference) Misery of Misalignment by Sequence Stillmotion (Sep. 12, 2013). https://www.youtube.com/watch?v=xJciNY8QtQA.
Nike Performance Graphic 5mmYoga Mat (6 pages) (retrieved Jul. 2, 2014). http://store.nike.com/us/en_us/pd/performance-graphic-5mm-yoga-mat/pid-659784/pgid-781669.
Perforated foam Eco Yoga mat (8 pages) (retrieved Jul. 2, 2014). http://www.alibaba.com/product-detail/Perforated-foam-Edo-Yoga-mat_1480480449.html.
Liat Clark, "Pose smarter with reactive LED yoga training mat," Technology, 4 pages (Jun. 9, 2014). http://www.wired.co.uk/news/archive/2014-06/09/digital-yoga/mat/viewgallery/335239.
U.S. Appl. No. 14/280,061, Office Action, dated May 5, 2015.
U.S. Appl. No. 14/280,061, Final Office Action, dated Jul. 14, 2015.
U.S. Appl. No. 14/280,061, Notice of Allowance, dated Aug. 11, 2015.

* cited by examiner

170
TOP
OVER
UNDER
SIDE
CUT-AWAY 172
174
176
102

172
176

172
176

170
102
100

180
184
182
TOP
184
OVER
UNDER
185
SIDE
185
CUT-AWAY 182
185
186
102

182
186

182
186

180
102
100

YOGA AND EXERCISE MAT WITH ATTACHABLE MARKERS

This application is a continuation-in-part of application Ser. No. 14/280,061 filed May 16, 2014, the entire content of which is expressly incorporated herein by reference thereto.

BACKGROUND OF THE INVENTION

1. Field of the Invention

The present invention particularly pertains to yoga and exercise mat constructed in such a way so as to physically attach a plurality of markers that can be securely affixed to the mat, in order to better help yoga performers or exercisers maintain a proper posture, enhance their physical form, positioning and to greatly minimize a potential safety hazard and the risk of injury. In particular, the attachable markers are manufactured in an array of different shapes, styles and colors to especially aide those individuals who are visually impaired. The markers can further be personalized, whereby the exercising individual can print thereto his/her own messages, so as to direct and motivate him/herself with the ultimate end-goal of achieving enhanced exercise result.

2. Background

Staying physically active and exercising is an essential part of life, as maintaining an active life-style not only replenishes a person's state of mind by releasing chronic tension and increasing self-awareness, but also ensures that chronic diseases and various other ailments are effectively kept in check. It is clear, that as the incidence of debilitating medical conditions such as but not limited to heart diseases and cancer diminish due to an improved public awareness regarding maintaining a healthy life-style and regular physical activity, there is still an unmet need for exercise mats from the perspective of actively exercising individuals, that greatly aide in the improvement of their physical form and maintenance of correct posture during the physical work-out session.

Yoga and exercise mats have been accessible in a plethora of distinct shapes, colors, designs and materials heretofore. Exercise and yoga mat designs with printed indicia and grids are available in order to assist visually impaired exercisers in maintaining a proper body posture and alignment and to assess incremental improvements in flexibility.

There exists a number of United States patents and patent application publications that display the general purpose of teaching exercise and yoga mats.

U.S. Pat. No. 3,935,653 issued to Klein which has the title "Beach Blanket staking Device" describes a push-in and pull-out peg or stake-device having a drive stem and a frame-like drive head primarily for holding-down blankets or covers such as at highly windy beach areas.

U.S. Pat. No. 6,387,013 issued to Marquez entitled "Exercise Alignment System" teaches an exercise mat system for providing reference to an individual performing yoga exercises. The inventive device includes a mat having a first center line, a second center line orthogonal to the first center line, a plurality of first lines parallel to the first center line, and a plurality of second lines parallel to the second center line. The mat is a flat structure which may be comprised of a resilient and cushioned material. A plurality of markers may be positioned at the intersection of the lines for increased visual references. The exerciser is able to have a visual reference regarding the respective position of their feet, hands and body during an exercise.

U.S. Pat. No. 6,663,537 issued to McCoy entitled "Exercise Mat" pertains to a non-slip exercise mat for use on multiple surfaces including at least one layer of material having a top surface, a bottom surface and side surfaces. The mat also includes systems for removably securing the mat to carpeted surfaces and for preventing the mat from slipping on non-carpeted surfaces. Both systems can be joined with the bottom surface or joined on opposite surfaces of the mat. The mat may include shock absorbing materials, as well as texturized, slip-resistant materials. The mat may also include a cover for the system for removably securing the mat to carpeted surfaces.

U.S. Pat. No. 6,935,382 issued to Buckley entitled "Exercise Rug With Contours" discloses a woven exercise rug. The exercise rug has contours on an exercise surface to reduce the chance of a user slipping during an exercise. The woven material provides moisture relief and contours provide additional gripping for the user of the rug to help reduce the chance of slippage due to perspiration.

U.S. Pat. No. 7,069,607 issued to Nichols with the title "Absorbent Towel With Projections" generally teaches a yoga mat made from a towel. The towel comprises a base layer and a plurality of raised projections that project away from the base layer. The projections are made from plastic, rubber, or epoxy and are used to provide grip to a floor surface. The top surface, as a towel material, is water absorbent to prevent slipping during yoga positions. The surface of the towel includes a focal region designed to be a visual focus point to assist with concentration during the practice of yoga, martial arts or other sporting activities.

U.S. Pat. No. 7,108,635 issued to Howlett-Campanella and titled "Yoga Mat With Body Contact Placement Indicia" teaches a mat having a symmetrical body placement guide. The guide is imprinted on an upper surface of the mat, and is used to aid a yoga performer with proper body alignment during yoga postures, and to track flexibility progress. The body placement guide includes a pattern design, a longitudinal axis and transverse axis that define four quadrants.

U.S. Pat. No. 7,955,224 issued to Curley with the title "Yoga Mat with intuitive tactile Feedback for visually impaired" is concerned with an exercise mat that provides intuitive tactile feedback, allowing a user to determine body placement using the sense of touch. The mat enables visually impaired exercisers to determine location and direction on the mat. The mat comprises placement stations that are distinguishable by shape, elevation, concavity, texture or otherwise devices that are perceptible by touch to assist a user in correct foot and hand placements during a yoga posture-sequence, an exercise-program, a dance routine and the like.

U.S. Pat. No. 8,220,087 issued to Villa entitled "Exercise Mat" generally teaches an exercise mat including a plurality of supports positioned for specific body parts that provides a proper cushioning for the exercising individual. The supports may be integrally formed into the mat or removable. The exercise mat may further comprise a cover. The cover may have pockets or holes to receive the supports. The bottom of the mat or the cover may be made from non-slippage material.

U.S. Pat. No. 8,499,383 issued to Ungaro entitled "Exercise Mat with visual Markers for Alignment" has an object of teaching exercise mat-system that includes an exercise mat comprising an upper surface, and a plurality of visual markers positioned on the upper surface of said mat, where the relative positioning of the visual markers correlates to a user's body parts and distances between the user's body parts.

U.S. Pat. No. 8,966,681 to Burch discloses a mat comprising an origin that is positioned along one of a first axis and a second axis; a first indicia that is positioned symmetrically relative to the origin; and a second indicia that is positioned symmetrically relative to only one of the axes. The first indicia can include a plurality of longitudinal lines that are substantially parallel to one another. The plurality of longitudinal lines can include (i) a longitudinal centerline, (ii) a pair of first longitudinal lines that are equally spaced on either side of the longitudinal centerline, (iii) a pair of second longitudinal lines that are equally spaced on either side of the longitudinal centerline, and a pair of third longitudinal lines that are equally spaced on either side of the longitudinal centerline.

U.S. Pat. No. 8,701,654 issued to Newburger with the title "Exercise Mat and System for ensuring proper Form and Posture during Exercise" pertains to an exercise system having a mat which is dimensioned to support a user stretched out on the floor. The mat comprises a central fastening band disposed widthwise across the mat. A belt fits around the midsection of the user adapted to be aligned with and also adhere to the fastening band of the mat. The user is intended to perform certain flexibility exercises with the belt in contact with the fastening band.

U.S. Patent Application Publication 2002/0142888 to Marques et al. discloses an exercise alignment mat system for providing reference to an individual performing an exercise such as yoga. The mat had a first center line, a second center line orthogonal to the first center line, a plurality of first lines parallel to the first center line, and a plurality of second lines parallel to the second center line. The mat is a flat structure which may include a resilient and cushioned material. A plurality of markers may be positioned at the intersection of the lines for increased visual references. The student is able to have a visual reference regarding the respective position of their feet, hands and body during an exercise. In an alternative embodiment, the mat includes a first extended portion and a second extended portion on opposite sides of the mat.

U.S. Patent Application Publication 2003/0017915 by Prinzmetal entitled "Mat" teaches a mat for use with floor exercises. The mat comprises intersecting centerlines, a pair of hand references zones, and a pair of foot reference zones. Reference zones for hand and foot are made of vertical and horizontal utility strips. Utility strips may be fixed, or may be removed and repositioned in order to mark incremental improvements.

U.S. Patent Application Publication 2004/0214692 by Koenig titled "Grid On An Exercise Product And Exercise System Therewith" relates to an exercise mat having intersecting straight lines and sequential reference indicia. The mat of Koenig provides a grid of marks. Lines in the grid of marks can be visibly different in color, thickness and type (such as dashed lines), and can have a convex or concave protrusion from the surface of the exercise mat to differentiate one mark from another. The grid of lines may be used to assist in exercise alignment to measure stretching progress from one week to another week, or to identify correct dance movements.

U.S. Patent Application Publication 2004/0229731 by Mitchell entitled "Exercise Mat With Printed Indicia Thereon" discloses a low impact exercise mat. The exercise mat has two sets of printed indicia. One set of indicia is to identify a location on the mat, while the second set is used to identify direction on a mat. The mat can be used to follow an exercise regimen for associative learners, visual learners, mathematical learners, spatial learners, auditory learners, kinesthetic learners, interactive learners. The mat of Mitchell uses printed indicia and relies on visual cues.

U.S. Patent Application Publication 2004/0250346 by Vasishth with the title "Anti-slip multi-layer Yoga Mat" has a main objective of teaching anti-slip, multi-layer exercise mats having an upper fabric layer, a lower pliable foam layer, and an intermediate adhesive such that during use, the mat provides the athlete with safety and comfort and during transport or storage the rolled mat provides convenience.

U.S. Patent Application Publication 2006/0040811 by Foster having the title "Floor Exercise Mat and Pad System" is concerned with a floor exercise mat and pad system comprising a mat and support pads, in which the pads can be selectively attached to the mat for the purpose of comfortably supporting a user's neck, back or other body areas in the course of performing exercise or stretch while lying on the mat. The system may also include a removable cover for the mat and an elastic band for holding the mat in a coiled position.

U.S. Patent Application Publication 2006/0073305 by Kole entitled "Yoga Mat" generally teaches a yoga mat having several arms. The yoga mat has a central segment from which a plurality of substantially equidistant arms extend outwardly. The mat of Kole enables a mat user to practice a variety of yoga positions without needing to reposition the mat.

U.S. Patent Application Publication 2007/0275827 by Glaser having the title "Yoga Mat" discloses mats that provide improved balance, stability, relief of joint and knee pain and improved grip. One particular mat has an upper surface with protrusions such as knobs in order to provide a feeling of acupressure massage to the user. The mat may be continuous and rolled up for storage, or may be divided into sections and folded. A layer of foam is provided for cushioning purposes.

U.S. Patent Application Publication 2010/0299833 by Kessler having the title "Exercise Mat with Integral Repositionable Support Assemblies" demonstrates an exercise device with a mat portion and a plurality of support assemblies. The mat portion defines a plurality of holes. Each support assembly has a support member, a support bridge, and one or more support inserts. The support member has a flat bottom and a bolster-shaped top and defines one or more cavities that extend through the bottom of the support member and into the interior of the support member. The support inserts are generally hollow and are fitted into the cavities in the support member. The support bridge defines one or more projections that extend upwards from and generally perpendicular to the top of the support bridge. Each projection is sized and shaped to fit through one of the holes in the mat portion. The interior surface of each of the support inserts defines a plurality of grooves, each of the projections defines a plurality of ridges, and the grooves and ridges are adapted to form a press fit when coupled together, to removably couple the mat portion between the support member and the support bridge. The support assembly may be removed and repositioned to different locations on the mat portion as desired by a user.

U.S. Patent Application Publication 2011/0131723 by Andrews with the title "Combined Yoga Strap and Mat" shows a combined yoga exercise mat and yoga exercise strap which are movable to: (a) a hanging position in which the yoga exercise strap is attached to the yoga exercise mat to facilitate hanging the yoga exercise mat for washing, air drying and storage, to (b) a carrying position in which the yoga exercise mat is rolled and the yoga exercise strap is positioned about and secures the rolled yoga exercise mat and in which the yoga exercise strap can be positioned on a shoulder of a person to help carry the rolled yoga exercise mat, and to (c) an exercise position in which the yoga exercise strap is detached from the yoga exercise mat so that a person can perform yoga exercises with the yoga exercise strap and on the yoga exercise mat.

U.S. Patent Application Publication 2013/0180048 by Saltzman entitled "Exercise Yoga Mat and Methods of using same" generally relates to an exercise yoga mat, where the mat has printed indicia for measuring distance along the surface of the mat, while executing yoga exercise positions.

U.S. Patent Application Publication 2013/0324382 by Wilson with the title "Multi-Function Exercise Mat with detachable Implements and Method" demonstrates a non-planar exercise mat comprising a plurality of detachable handheld implements, each handheld implement serving utilitarian function independently of the mat. Various embodiments of Wilson's invention include permanently affixed or detachable cushions for tail-bone support; lumbar support; neck support and the like. Different embodiments cover handles for assisting a user in performing a variety of exercises upon using the mat.

While the prior art mentioned hereinabove teaches various forms of yoga and exercise mats with distinct functionalities, there still remains a need to improvements in such prior art mats in order to better help the exercising individual maintain a consistent alignment during an exercise workout-session, improve the exercising individuals form, while at the same time potentially diminishing acquiring an injury. The present invention now provides a yoga or exercise mat that provides such improvements.

SUMMARY OF THE INVENTION

The invention is directed to a relates to a yoga and exercise mat comprising a body having a longitudinal length, a width and a top surface; body position marking locations provided on the top surface of the mat; and markers operatively associated with certain of the body position marking locations, such that an individual using the mat can obtain enhanced results during physical activity by associating the markers with the marking locations for maintaining proper alignment, correct form, positioning and posture during yoga or exercise.

The mat has a generally rectangular shape and the marking locations are provided in a grid-like pattern. The top surface is substantially planar and includes an alignment guide for positioning of the markers with the marking locations. Advantageously, the alignment guide comprises a circle located at the center of the mat and a straight line bisecting the circle, extending along the center of the width of the mat and forming the center of the width of the grid-like pattern.

Preferably, the markers are attached to the marking locations. The marking locations are holes in the top surface of the mat and the markers include a hole-engaging structure for attachment thereto. The holes typically have a narrower opening and a wider lower portion and wherein the engaging structure of the markers is a plug that has a wider leading end and a narrower stem so that the leading end of the engaging structure of the markers is received by and conforms to the lower portion of the holes.

The top surface of the mat may be made of a different material than the rest of the body so that it has sufficient strength and thickness to securely retain the markers to the holes. Also, the markers have a color that is different from and contrasts with the color of the mat. The markers may have a round or polygonal perimeter and an upper portion that extends above the mat so that the individual can locate the markers by touch. If desired, at least some of the markers include a handle for grasping by the individual. Additionally, the upper portion of the markers may include a message or other indicia thereon that is personalized for the user.

Another embodiment of the invention is a yoga and exercise mat comprising a body having a longitudinal length, a width and a top surface; body position marking locations provided on the top surface of the mat; and markers operatively associated with certain of the body position marking locations, such that an individual using the mat can obtain enhanced results during physical activity by associating the markers with the marking locations for maintaining proper alignment, correct form, positioning and posture during yoga or exercise. At least some of the markers include a handle for grasping by the individual.

Preferably, at least some of the handles are attached to the mat with screws or have threaded shafts that engage the mat holes so that they do not pull out during use. Preferably, the markers are removably attached so that they can be attached in desired locations depending upon the size and exercise goals of the user.

Another embodiment of the invention is a yoga and exercise area comprising a floor area having a longitudinal length, a width and a top surface and one or more sub-areas providing space for an individual to conduct yoga or other exercises. The sub-area includes body position marking locations provided on the top surface of the floor; and markers operatively associated with certain of the body position marking locations, such that an individual using the mat can obtain enhanced results during physical activity by associating the markers with the marking locations for maintaining proper alignment, correct form, positioning and posture during yoga or exercise. The yoga and exercise area preferably includes a plurality of sub-areas for providing space for a plurality of individuals to conduct yoga or other exercises.

The floor includes a top surface of a pliable and flexible material of plastic, an elastomer or bamboo having a thickness that can effectively absorb shock during exercise, wherein the marking locations are provided in the top surface of the floor in a grid-like pattern, the top surface of the floor is substantially planar and includes an alignment guide for positioning of the markers with the marking locations. The markers are preferably attached to the marking locations with the marking locations being holes in the top surface of the floor or in a single layer mat and with the markers including a hole-engaging structure for attachment thereto. The markers typically have a color that is different from and contrasts with the color of the mat, have a round or polygonal perimeter and an upper portion that extends above the floor so that the individual can locate the markers by touch or at least some of the markers include a handle for grasping by the individual. Some or all of the markers can be permanently attached but preferably are removably attached so that they can be tailored to the size of the person who is using the mat or floor containing the mat.

Another embodiment of the invention relates to a yoga and exercise mat comprising a body having a longitudinal length, a width and a top surface; a plurality of holes through the body arranged in a predetermined pattern; a center line provided on the top surface of the mat; a plurality of permanent markings located along the center line; a plurality of markings located off the center line; and markers operatively and selectively associated with certain of the holes, such that an individual using the mat can obtain enhanced results during physical activity by associating the markers with the holes and utilizing the markings for selecting locations for maintaining proper alignment, correct form, positioning and posture during yoga or exercise. The mat is preferably made of a single layer of a suitable exercise base material preferably has rectangular ends, optionally with rounded corners, and a widened central area to provide an expanded area for exercising thereon.

For these yoga and exercise mats, the markers include a head, a smooth, ribbed or threaded shaft and an enlarged bottom lip that snaps into the mat. The markers may include a ring surrounding the head for providing the marker with a different color than the head. If desired, the head may include an indicia, emblem, symbol, circle or polygon therein, with the head optionally being of a different color from the indicia, emblem, symbol, circle or polygon. Alternatively, the markers may include a central opening in the head so that the head appears as a ring when the marker is placed on the mat.

The yoga and exercise mats of the invention can be used as a portable mat that a user can bring to an exercise location, such as a gym, or they can be installed as the upper surface of a floor in a gym or exercise location so that the user simply has to bring his or her markers to the location when exercise is desired. For this, the user may bring his or her personalized markers or markers can be provided by the gym or exercise location for temporary use or purchase.

Another embodiment of the invention is a method of customizing a yoga or exercise mat for use by a particular individual, which comprises providing the mat disclosed herein so that the individual can apply a number of markers to the respective body position marking locations provided on the top surface of the mat that conform to the individual's size or shape, such that the individual using the mat can obtain enhanced results during physical activity by associating the markers with the marking locations for maintaining proper alignment, correct form, positioning and posture during yoga or exercise.

BRIEF DESCRIPTION OF THE DRAWINGS

FIG. 5, views D, E, F and G, schematically show a plurality of different materials that are used in the construction of the mat in accordance with various embodiments of the present invention.

FIG. 5, views H, I and J, schematically depict different ways that the mat can be folded in accordance with various embodiments of the present invention.

FIG. 6 is a view of the mat to illustrate the through holes for mounting markers, with FIG. 6A illustrating an enlarged marker while FIG. 6B illustrates an enlarged portion of the mat.

FIG. 8A illustrates the positioning of a person on the mat using the markers, while

FIGS. 9B, 10B, 11B and 12B illustrating marker structures; and FIGS. 9C, 9D, 9E, 10C, 10D, 10E, 11C, 11D, 11E and 12C, 12D and 12E illustrating the insertion of the marker into the mat.

DETAILED DESCRIPTION OF THE INVENTIVE EMBODIMENTS

Figure 1:
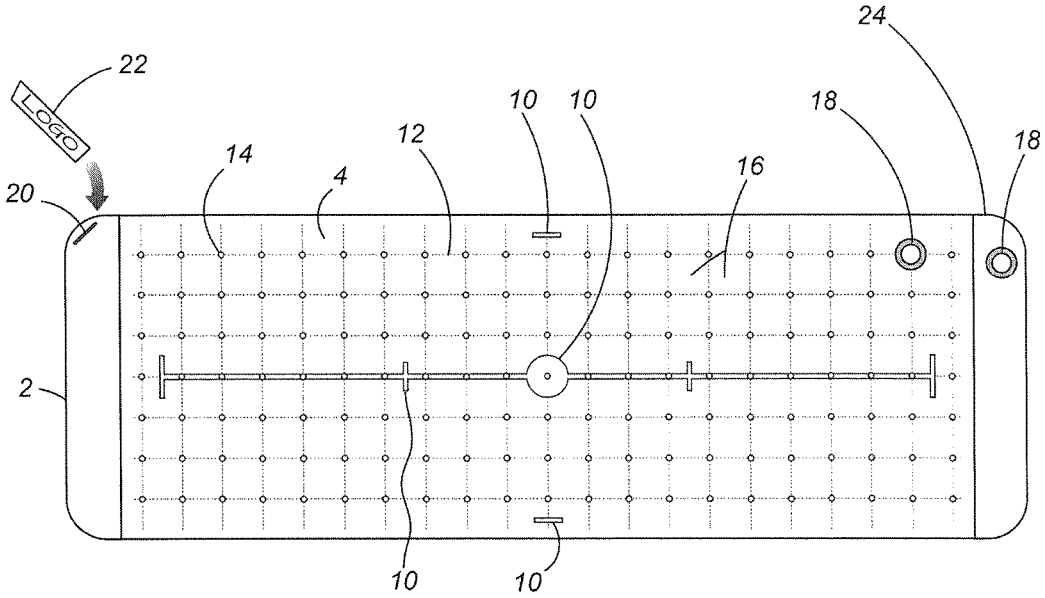
FIG. 1 is a top-plan perspective of a preferred embodiment of the yoga and exercise mat and the attachable marker respectively.

The following definitions set forth the parameters of the present invention.

As used herein, the term "longitudinal" refers to the running lengthwise rather than across the width of a material.

As used herein, the term "yoga" refers a Hindu spiritual discipline, a part of which, including breath control, simple meditation, and the adoption of specific bodily postures, is widely practiced for health and relaxation. It is a system of exercises for attaining bodily or mental control and well-being.

As used herein, the term "marker" refers to any physical object, item, peg or material with any shape, form or size provided with a plug, that has a wider leading and a narrower stem, in order to securely attach the markers to the plurality of holes of the mat, such that an exercising user can achieve enhanced results during a physical activity, by associating the markers with the marking locations on the mat for establishing most optimal alignment, correct form and posture during yoga or exercise.

As used herein, the term "grid-like pattern" refers to affixed pattern on the mat, such that holes can be constructed symmetrically on the mat, which as stated above serve the main purpose of attaching the markers. Each grid-like pattern is formed as a square on the mat and measures at least about 3×3 inches, wherein each corner on each square has a hole constructed thereon. Furthermore, "the grid-like patterns" also have a functionality to symmetrically set up the alignment guide on the mat.

As used herein, the term "alignment guide" refers to i) a straight line following the path of the "grid-like pattern" longitudinally situated exactly in the middle of the mat separating the mat into two equal sized halves, ii) a circle bisected by the straight line, and iii) six additional "alignment guides", that allow the exercise performing individual to attach the markers in such a way, so as to exclusively achieve the most optimal symmetrical alignment of the markers during the work-out session.

As used herein, the term "body position marking location" entails the top surface of the mat, which further comprises "grid-like patterns" and "alignment guides".

As used herein, the term "Mat floor grip" is a built in function on the mat constructed immediately beneath the holes of the mat, which ensures that the attached markers securely stay put on the mat.

As used herein, the term "planar" refers to the top surface of the mat being made up of flat planes.

As used herein, the term "substantially" should be understood as being synonymous to largely, mainly, basically or fundamentally.

As used herein, the term "bisecting" refers to the division into two equal parts.

In view of the foregoing and the description provided herein, the current specification of the instant application will clearly set forth the disadvantages inherent in the prior art heretofore comprising exercise mats, as the present invention provides a novel yoga and exercise mat with several notable advantages over the prior art.

As shown in the figures, the present invention now provides a yoga and exercise mat 2, wherein the body of the mat 2 comprises a longitudinal length in full communication with a width perpendicular to the longitudinal length, and a top surface 4, wherein the top surface 4 includes body position marking locations comprising an alignment guide 10, a plurality of grid-like patterns 12 and marker holes 14 equally and symmetrically distanced in relation to one another, whereby the plurality of marker holes 14 conveniently allow the attachment of a plurality of marker types 18 (FIG. 1), 28 (FIG. 3A and FIG. 4F), 30 (FIG. 2, FIGS. 3B-3D, FIG. 4A), 32 (FIG. 4D), 34 (FIG. 4B), 36 (FIG. 4B), 38 (FIG. 4E), 40 (FIG. 4E), 42 (FIG. 4E), 44 (FIG. 4C) and 46 (FIG. 4G), which thereby become operatively associated with the body position marking locations on the mat 2. The markers may be manufactured in a plurality of distinct shapes and forms, and may equally well be composed of a plurality of different colors. The markers are characterized by having a distinct color that is different from and contrasts with the color of the mat 2. The markers serve as a major purpose to greatly aide yoga performers or exercisers who are visually impaired, which can further be personalized, whereby the exercising individuals can write their own messages to direct and motivate themselves with the ultimate ambition of obtaining improved exercise results by establishing a proper alignment, correct posture and form on the mat 2 during an exercise-session.

One of the obvious advantages is to be able to easily and securely attach to the mat a plurality of differently shaped, formed, sized and colored markers, so as to effectively enable the exercising individual to enhance the performance of the individual during a workout program.

This is especially true, because the exercise performing individual can affix either a single, or a plurality of either the same, or differently shaped markers anywhere on the mat that the exercising individual so pleases all depending on what the major end-purpose of a given exercise-routine is.

Another obvious advantage that is provided by the instant invention is directed to visually impaired exercise performers, who are accordingly able to easily see the markers due to the plurality of different colors of the markers, which clearly contrast with the color of the mat, thereby advantageously minimizing the risk of acquiring a potential injury during a routine exercise work-out program.

A further advantage of the present invention comprehends the personalization of the exercising individual by printing his/her messages onto the markers, so as to efficiently motivate or inspire him/herself during an exercise workout-routine.

The detailed description of the instant invention will now be provided generally with reference to FIGS. 1-5, with it being clearly understood that these figures are merely provided as exemplary in nature and should in no way serve to limit the scope of the invention, which is solely defined by the appended claims appearing hereinbelow.

Thus in accordance with one embodiment of the invention, as best demonstrated in the top-plan perspective view as depicted in FIG. 1, the invention specifically pertains to a yoga and exercise mat 2, which is generally constructed rectangular in shape, and wherein the main components of the mat 2 comprises a longitudinal length in complete cooperation with a width in perpendicular configuration relative to the longitudinal length, and a top surface 4, wherein the top surface 4 further includes body position marking locations, which are made up by an alignment guide 10 situated precisely in the center of the mat 2.

The alignment guide comprises a circle located at the center of the mat and a straight line bisecting the circle extending along the center of the width of the mat 2.

Further the mat 2 comprises a plurality of marker holes 14, identically distanced in relation to one another 16, whereby the plurality of marker holes 14 constituting marking locations on the mat 2 conveniently operatively allow the attachment of a single, or a plurality of identical or different marker types before initiation of an exercise-session, and similarly detachment of the markers post the exercise-session.

As best illustrated in FIGS. 1 and 5D-5G, the top surface of the mat 2 is substantially planar and is made of a different material than the rest of the body including the portion that is immediately beneath the top surface 2, and has a sufficient strength and thickness to securely retain the plurality of markers to the holes.

The top surface of the mat 2 may be constructed and manufactured from any pliable and flexible material known to the person skilled in the art such as but not limited to rubber, vinyl, bamboo, PVC or any other material that can effectively absorb shock during the exercise.

Preferably, the mat 2 is molded in one piece. The construction of pliable material offers the great advantage of being easily stored or transported to a work-out session class.

The flexible material further provides support and stability for performing balancing acts and postures as opposed to keeping a balancing positioning on a cushioned surface.

Figure 4:
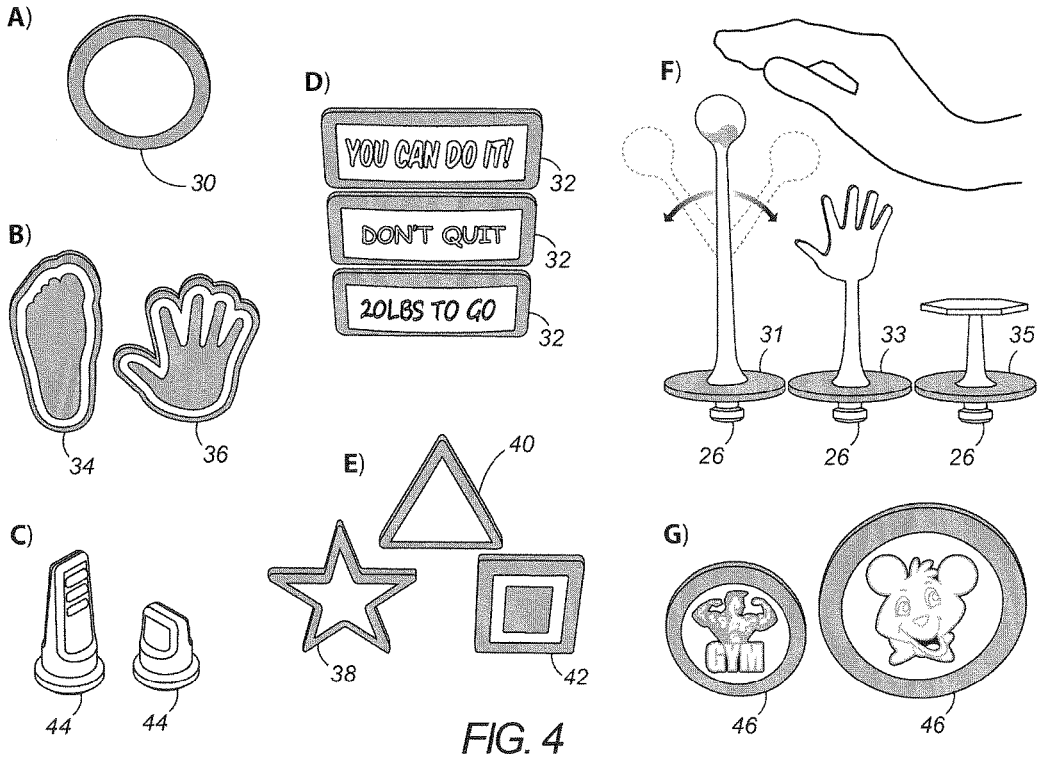
FIG. 4, views A, B, C, D, E, F and G, depict differently shaped markers in accordance with various embodiments of the present invention.
Figure 5:
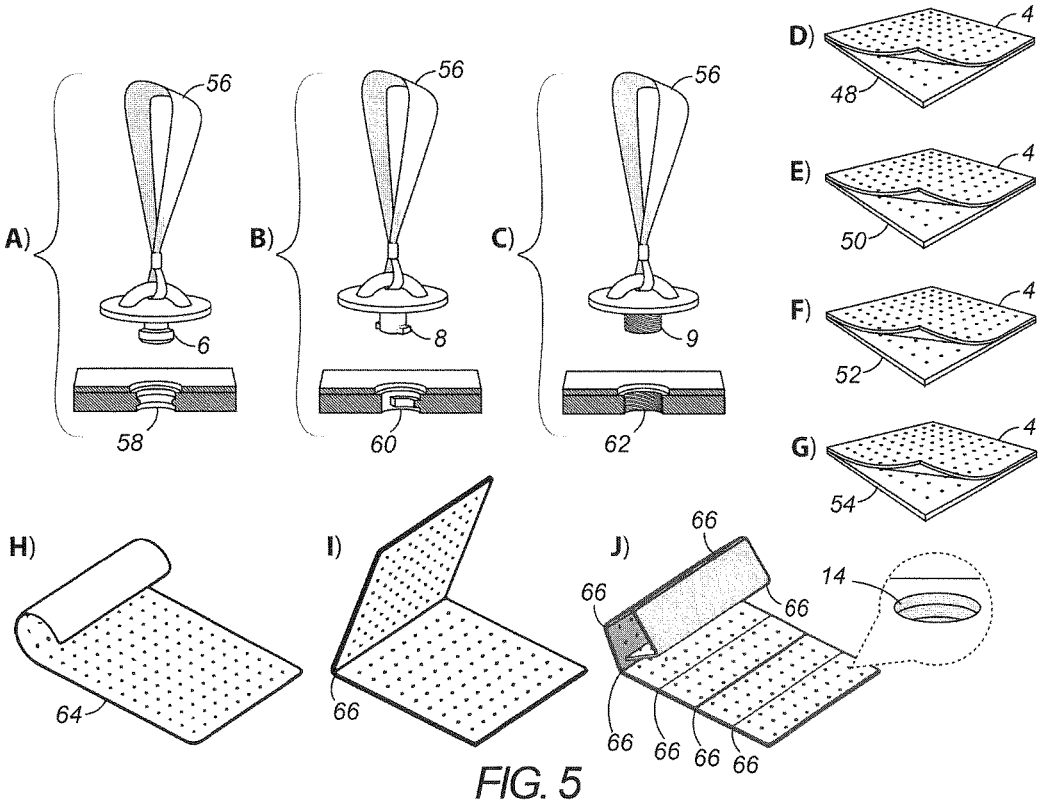
FIG. 5, views A, B and C, schematically demonstrate different locking mechanisms of a strap which is inserted into a hole on the mat in accordance with various embodiments of the present invention.

As depicted in FIG. 4, the portion of the mat 2, that is located right beneath the top surface 4 may be constructed of any suitable soft material known in the art, or may in various other embodiments equally well be composed of a hard material for example but not limited to wood 48, plastic 50, metal 52 or carbon fiber 54. The hard material can provide a strengthened surface to or through which the markers can be attached according to one of the attachment means described herein.

As seen in FIG. 1, the mat 2 comprises a plurality of equally sized square grid-like patterns 12, which cover the entire upper surface 4 of the mat 2. These square-shaped grid-like patterns 12 serve a major purpose of symmetrically creating the plurality of marker holes 14, wherein each of four marker holes 14 are located on each of four corners created by the grid-like patterns 12. In the most preferred embodiment, the marker holes 14 have a narrower opening and a wider lower portion, and are spaced from each other at a distance of at least about 3×3 inches, into which, the marker 18 as shown in FIG. 1, or according to different embodiments, the plurality of different marker types 18

Figure 2:
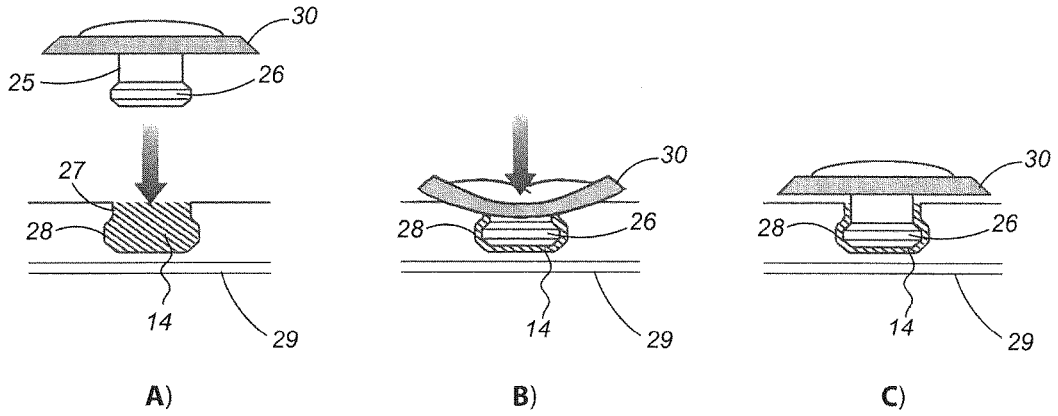
FIG. 2, views A, B and C, are side views depicting how a basic circular marker is inserted into a marker hole on the mat in accordance with one embodiment of the present invention.
Figure 3:
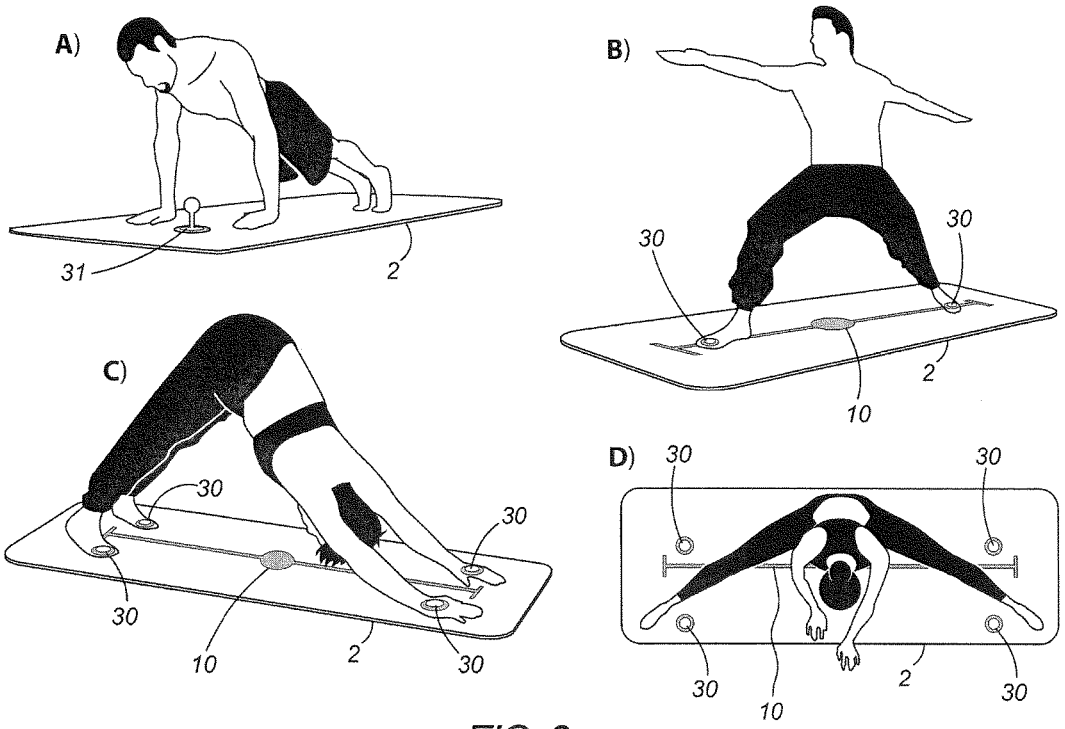
FIG. 3, views A, B, C and D, schematically depict the use of the mat by different exercisers, where the use of differently shaped and positioned markers for distinct purposes is further demonstrated.

(FIG. 1), 28 (FIG. 3A and FIG. 4F), 30 (FIG. 2, FIG. 3B-3D, FIG. 4A), 32 (FIG. 4D), 34 (FIG. 4B), 36 (FIG. 4B), 38 (FIG. 4E), 40 (FIG. 4E), 42 (FIG. 4E), 44 (FIG. 4C) and 46 (FIG. 4G) are to be securely attached before the exercise and detached post physical activity. As best shown in FIG. 2 below, the engaging structure of the markers is a plug that has a wider leading end and a narrower stem, such that the leading end of the engaging structure of the markers is received by and conforms to the lower portion of the holes.

In addition, the grid-like patterns 12 also make it possible to easily construct the alignment guide 10 onto the top surface 4 of the mat 2, so as to allow the exercise performing individual to attach the markers, in order to achieve the most optimal symmetrical or asymmetrical alignment of the markers during the work-out session.

The mat of the present invention of the preferred embodiment has attachable and detachable markers that are produced and manufactured in a plurality of forms, shapes, styles and colors. Instead of the plug and hole configuration described previously, other forms of attachment, such as Velcro, a reusable adhesive, buttons or snaps, or any type of temporary or subsequently removable securement can be used to temporarily secure the markers to the mat. In some embodiments, the areas of attachment can be magnetized and the markers magnetically adhered to the magnetized locations as desired.

As best demonstrated in FIG. 1, the alignment guide 10 comprises a circle located at the center of the mat 2 and a straight line bisecting the circle and extending along the center of the width of the mat 2.

Moreover, the alignment guide comprises at least six additional straight alignment guides 10, wherein four of them are on the extending straight line of the longest alignment guide 10 situated in an exact perpendicular configuration relative to the straight line, and the remaining two are located precisely in the middle of the mat 2 on each of opposite sides of the longitudinal length of the mat 2.

Further, the mat 2 comprises one slit 20 manufactured in one corner of the mat 2, which makes it possible to conveniently attach a tag 22 thereto. Tag 22 may include a logo or personalization tag to attach to the mat 2. The opposite corner of the mat 2 comprises an area 24 for unused markers to be placed during the exercise session.

The basic circular marker 30 may have a diameter of at least about 1.5 inches and a height including a rubber peg insert and the height may be at least about 0.60 inches. Of course, the precise dimensions are not critical and can vary depending upon the type of marker and its function. Thus, a circular marker would have a diameter of from 0.5 to 3 inches and peg insert lengths of 0.25 to 1" depending upon the width of the mat and the type of connection to be made to the mat.

FIG. 2 demonstrates in detail how to insert a basic circular marker 30 according to one embodiment of the invention into the marker hole 14 before an exercise routine begins.

First, one aligns the basic circular marker 30 with the marker hole 14, and then subsequently, one gently pushes the protruding plug 25 of the basic circular marker 30 into the marker hole 14. The wider portion 26 of the plug end 25 of marker 30 passes through the narrower end 27 of the hole 14 and then is seated in the wider portion 28 of the hole 14 so that it remains securely and efficiently attached and effectively stays in place on the mat 2 upon initiation of the physical activity. The mat floor grip 29, a roughened area beneath the mat 2 helps prevent movement of the mat during exercise.

As described herein, any one or more of a plurality of different markers 18 (FIG. 1), 28 (FIG. 3A and FIG. 4F), 30 (FIG. 2, FIGS. 3B-3D, FIG. 4A), 32 (FIG. 4D), 34 (FIG. 4B), 36 (FIG. 4B), 38 (FIG. 4E), 40 (FIG. 4E), 42 (FIG. 4E), 44 (FIG. 4C) and 46 (FIG. 4G) may be used according to various embodiments of the present invention for a variety of different purposes of exercise, in particular, to mark positions for hands, feet or body movements. The mat surface may include marking of certain preferred areas for placement of the markers as well as to provide instructions to the user.

Thus, it is completely up to the individual to decide which type of marker, as well as the location of placement of a given marker type on the mat 2 that will bring about the most optimal, productive and useful result for a given work-out session.

Further, in relation to this, it is to be understood that the same, or distinct types of markers can be used in conjunction, and can similarly be placed either symmetrically or asymmetrically on the mat 2, again all depending on which muscle groups, or part of the body to train and focus on during a given physical work-out session.

The markers have a round or polygonal perimeter and an upper portion that extends above the mat 2 such that the individual can locate the markers by touch.

As a way of example, this is best demonstrated in FIGS. 3A-3D, where four different individuals are using distinct types and different numbers of markers placed in different locations of the mat 2.

According to one embodiment, the user on the upper far left corner as demonstrated in FIG. 3A has chosen to use the stem marker 31 that is placed centrally on the mat 2, and the individual is performing push-ups to train the biceps and chest muscle groups. This type of marker assures, that the exercise-performing individual gets the most out of the physical activity, as the individuals chest touches the stem marker for every push-up that is performed. Moreover, the stem markers 31 are equipped with a bendable or flexible extension, such that the user can easily adjust the work-out to bend the extension, or if falling upon the extension will not be injured.

According to another embodiment, the user on the upper right corner as depicted in FIG. 3B is using two basic circular markers 30, which are placed centrally on the mat 2 as viewed according to the alignment guide 10, and appears to be using this subset of markers to achieve correct form and positioning during the work-out.

According to yet another embodiment, the person on the lower left corner as shown in FIG. 3C is using four basic circular markers 30 that are attached symmetrically relative to one another, where two of the markers are on the left side of the mat 2 and the remaining two are situated on the right side of the mat 2 separated by the alignment guide 10, where the individual is in a pilates snake position. The basic circular markers 30 have been positioned strategically, such that they help her stay consistent with her alignment during the workout routines. The unique symmetrical placement of the basic circular markers 30 ensures that all muscle groups in the back of her body are trained equally well, thereby greatly minimizing the hazard of acquiring an injury.

According to yet another embodiment, the individual on the lower right corner in FIG. 3D is again using four basic circular markers 30 that are placed symmetrically in relation to one another, but in this example, the markers 30 are not attached symmetrically relative to the mat 2. The upper marker pair has been placed close to the alignment guide 10, whereas the lower marker pair has been positioned close to the edge of the mat 2 and farther away from the alignment guide 10.

In this embodiment, the markers are set to monitor her progress, and the symmetrical placement of the basic markers 30 efficiently provides her with the ability to stretch out her inner thigh muscle groups and her back muscles upon leaning forward to a similar extent.

Thus, the mat 2 can also have longer or shorter longitudinal lengths, as well as longer or shorter widths, as long as the novel inventive key structural features of the mat 2 are preserved. The novel key features being the ability to attach a plurality of different marker types. As a way of example according to various embodiments of the invention, the shape of the plurality of different marker types may be characterized by being but not limited to a circle 18 (FIG. 1), which may have a flat or slightly raised or domed surface of the same or different color as the circle. Another circular marker is shown as 30 in FIG. 2, FIGS. 3B-3D and FIG. 4A.

Various sized and stylized stem markers 31, 33, 35, as shown in FIG. 3A and FIG. 4F, can be used to provide a raised target for the user to touch during exercising. As noted above, the elevated stems are made of a soft, flexible material to avoid injuring the user if inadvertently or unintentionally stepped or fallen upon during a workout. These stem markers each include a protruding plug with wider portion 26 for engaging a hole 14 in the mat 2 as shown in FIG. 2.

Markers providing motivational comments can be provided in rectangle markers 32 for use as further adornments to the mat 2 as well as to provide have personalized messages for the use, as shown in FIG. 4D. Markers corresponding to body parts are also possible: such as a foot 34 icon and hand icon 36 as shown in FIG. 4B. Colorful and desirable shapes, such as a star 38, triangle 40, or square 42, as shown in FIG. 4E are also possible, with the color of each one being uniform or mixed or with the perimeters being of a different color from the centers as shown. Large or small peg-like markers 44 as shown in FIG. 4C, can be used to designate additional areas for contact or boundaries of body positions. Of course, markers for branding purposes 46 as shown in FIG. 4G are also possible.

It also goes without saying that the shape, form and material of the plurality of markers should not be limited solely to the ones mentioned in this specification, as they may assume any other shape, size or material that is well-known, imaginable and within the full capability of the skilled artisan to which this invention belongs to.

In addition, the mat 2 may also have more or fewer alignment guides 10, or wherein the alignment guides 10 are located differently than specifically, as schematically demonstrated in FIG. 1. The plurality of holes 14 on the mat 2 may equally be constructed in different dimensions and different distances relative to one another if desired.

Moreover, as shown in FIGS. 5A to 5C, the marker hole 14 in a hole-section may additionally have a strap 56 affixed thereto, wherein the strap 56 is securely connected to the mat 2 via a locking mechanism which typically includes a snap lock 58, twist lock 60 or screw lock 62. The strap can also be permanently attached by gluing, rivets or other securing means to the bottom of the mat or between the upper hard layer and the lower softer layer.

In one embodiment, the locking mechanism of the strap 56 is constituted of a construction-feature including a snap lock 6, wherein a snap insert 58 on the mat 2 is similarly constructed, such that it conveniently allows the snap locking mechanism of the strap 56 to take place (FIG. 5A). This is similar to the snap locking feature of the markers shown in detail in FIGS. 2A to 2C.

In another embodiment, a twist lock 8 mechanism is used, in which the strap 56 is affixed by inserting the end into the hole and twisting it into a twist insert 60 (FIG. 5B) manufactured on the mat 2.

In yet another embodiment, a threaded lock 9 can beneficially be used, wherein the strap 56 is simply screwed into a threaded insert 62 (FIG. 5C) created on the mat 2.

Regarding dimensions, the mat has a longitudinal length that may measure at least about 71 inches with a width of at least roughly 24 inches and a thickness of least approximately 0.375 inches. Of course, other sizes can be used if desired.

There are various possibilities and variations with regard to the dimensions, configurations, as well as materials used to construct the yoga and exercise mat.

As described hereinabove in the inventive embodiments, a variety of different mat constructions are possible. These are shown in FIGS. 5D to 5E. The materials making up the upper surface 4 of the mat 2 may be constructed of sheets of pliable material such as but not limited to rubber, vinyl, bamboo or a thermoplastic such as PVC, PE or PB, and the surface that is located immediately beneath the top surface 4 is manufactured of a rigid material such as wood 48, a thermosetting plastic 50, metal 52 or carbon fiber 54. Of course, any other suitable combination of pliable and harder materials known in the art to a person of ordinary skill may be utilized, that provides the unique desired shock absorbing effect during the physical work-out from the upper surface softer material, as well as providing the mat 2 with a harder or more rigid lower surface that has sufficient strength, thickness and integrity to allow the markers to be securely but removably connected in the holes.

In the description of the inventive embodiments, the mat 2 has been described as being made in a generally rectangular geometry, but can similarly be fashioned into any other suitable geometric shape including but not limited to a circular, oval, triangular, pentagonal, hexagonal, heptagonal or octagonal mat.

Moreover, the skilled artisan will also readily understand and appreciate that the mentioned sizes of the dimensions of the individual entities are not solely limited to these values, as they are merely shown as examples for the inventive purpose of the different embodiments.

The mat 2 can be advantageously folded by a plurality of different ways which provides a highly beneficial effect to the exercising user for transportation purposes of the mat 2.

In one embodiment, the mat 2 can be rolled 64 from as depicted in FIG. 5I when the entire mat 2 is constructed using a design utilizing a soft and flexible material.

In another embodiment, the mat 2 can be folded along a fold line 66 as demonstrated in FIG. 5I manufactured exactly in the middle of the mat 2 thereby separating the mat 2 into precisely two equal halves when the top surface 4 is built up of a hard material.

In yet another embodiment, the mat 2 can be folded along a plurality of fold lines 66 as depicted in FIG. 5J, such that the mat 2 can eventually assume a more compact folded configuration when compared to the folding of the mat 2 as demonstrated in FIG. 5I.

Figures 6, 6A, 6B:
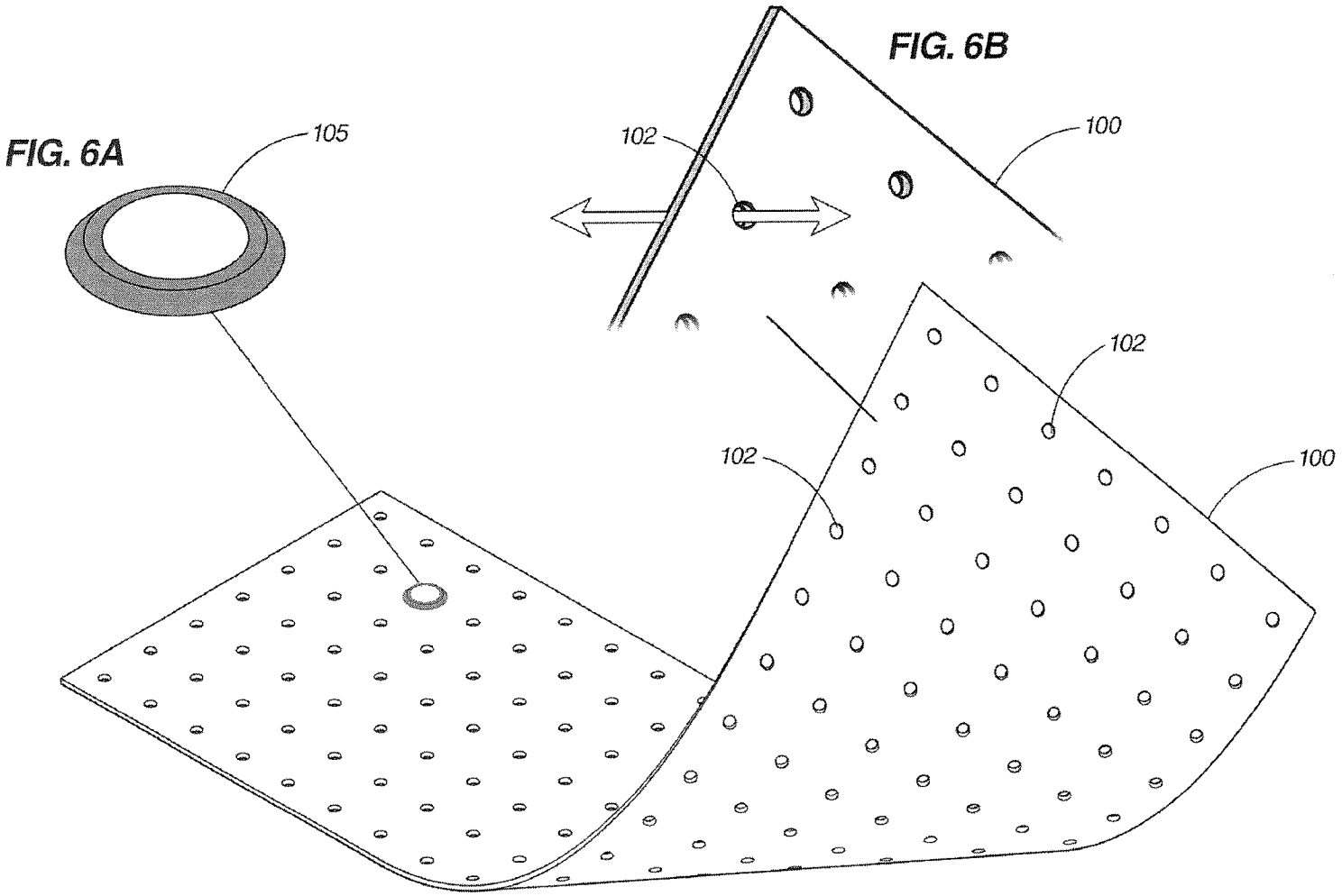

FIG. 6 illustrates an additional mat 100 according to the invention in the form of a rectangular sheet having a plurality of holes 102 therethrough arranged in a rectangular pattern. The holes 102 extend all the way through the mat as shown in FIG. 6B for receipt of a marker 105 as shown in FIG. 6A. The mat 100 is malleable and is composed of a single layer, with insert holes extending thought the surface of the mat, relieving the floor underneath.

Figure 7C:
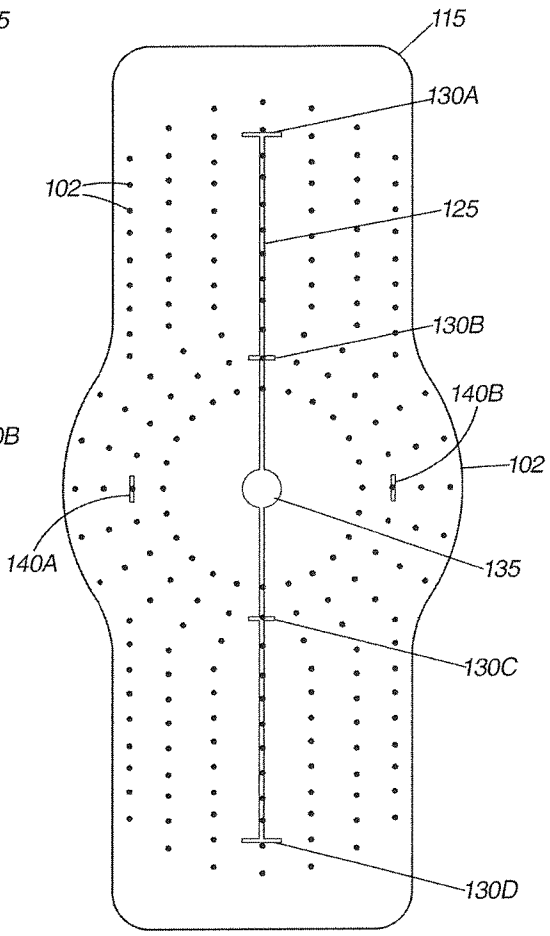
FIGS. 7A, 7B and 7C illustrate three different mat configurations according to the invention.
Figure 7B:
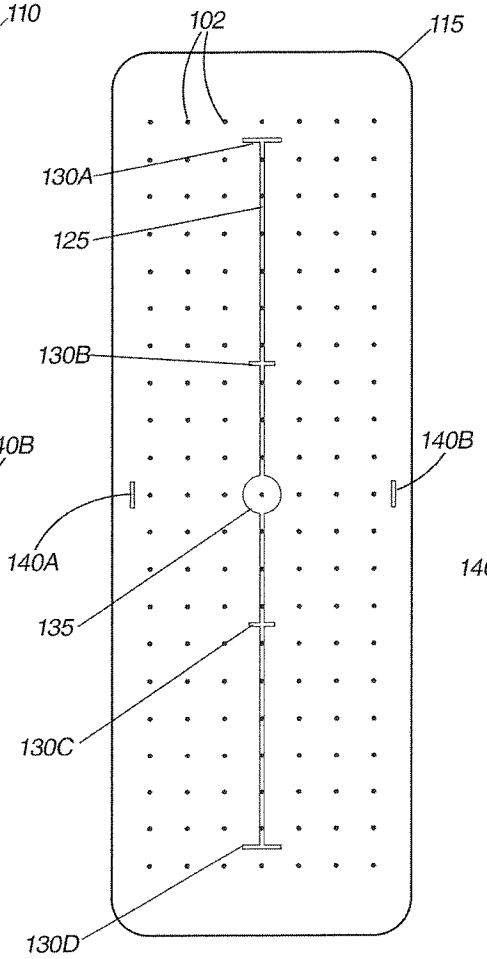
Figure 7A:
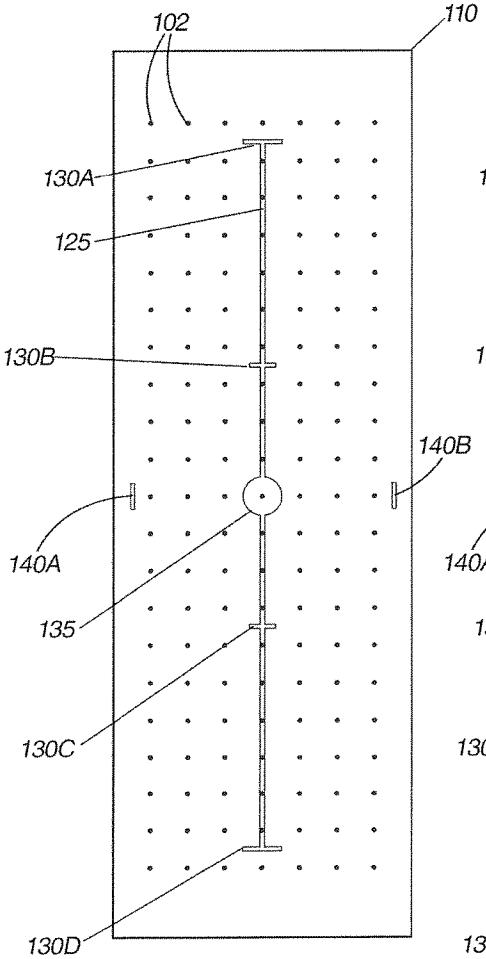

As shown in FIGS. 7A-7C, the mat 100 may be rectangular with the square edges 110 or rectangular with rounded edges 115. Also, if desired, the mat can be provided with a wider center area 120 to provide a greater width in the area where the person is exercising. For either embodiment, the mats have an elongated central line 125 with various guidelines thereon 130A, 130B, 130C, 130D and with a center guide 135 in the form of a circle. Two side guides 140A, 140B are also provided located on an imaginary line perpendicular to the central line and passing through center guide 135. These guides can be provided between or upon a mat opening 102, or at some other position on the mat.

These mats can be used as is or they can part of a sub-area of a floor that provides an exercise or yoga area for a person. The sub-area has the configuration of the mat and includes a longitudinal length, a width and a top surface that provides space for an individual to conduct yoga or other exercises.

Also, the mats of FIGS. 7A-7C either have square 90 degree corners, i.e., a standard mat, or can have the round corners to form an ergonomic mat. The new shape design of FIG. 7C provides benefits that allow the user to have more surface at the center of the mat. This feature, coupled with the attachable-markers, helps the user interact with the mat in a 360 orientation.

Figure 8A:
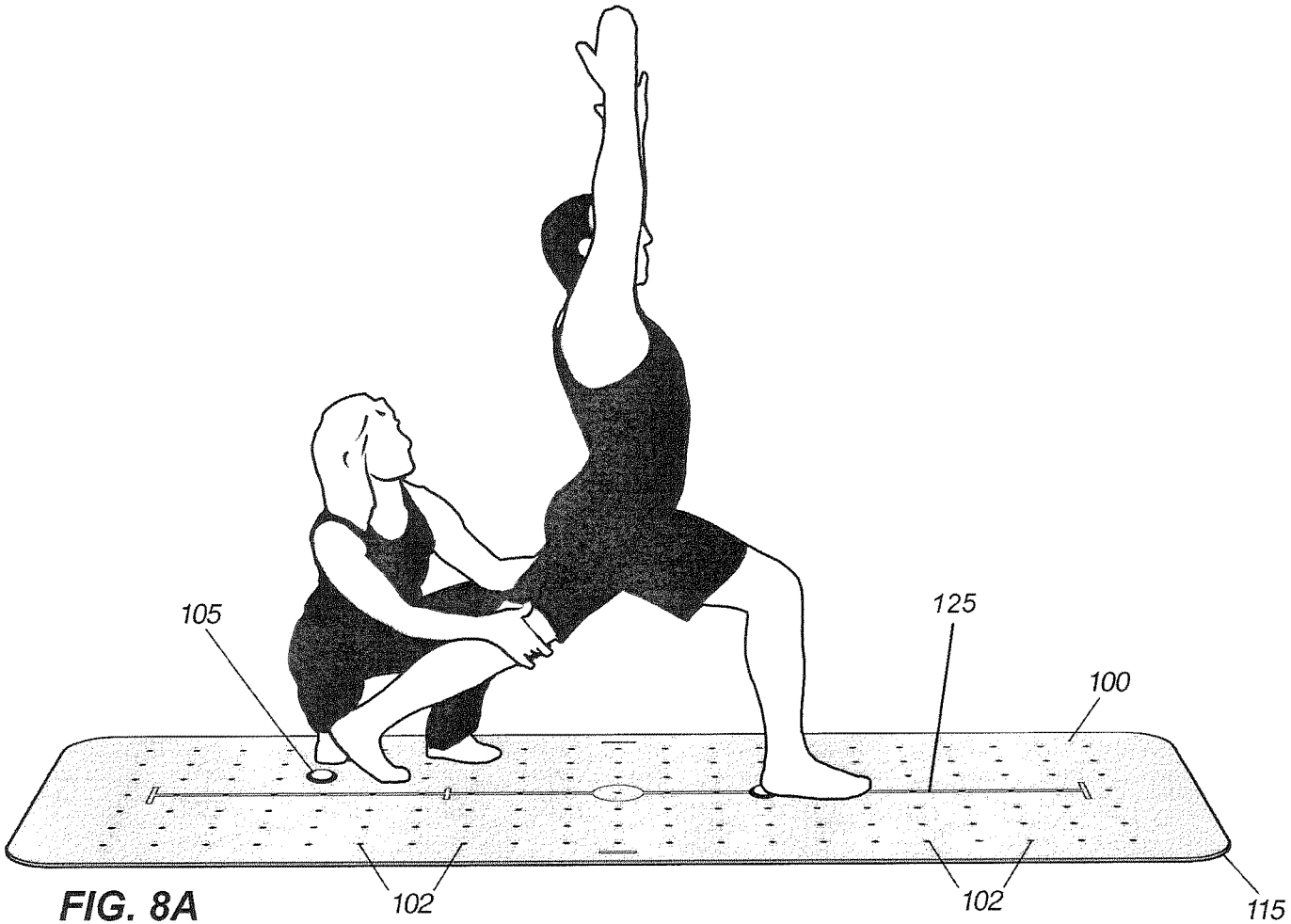
Figure 8B:
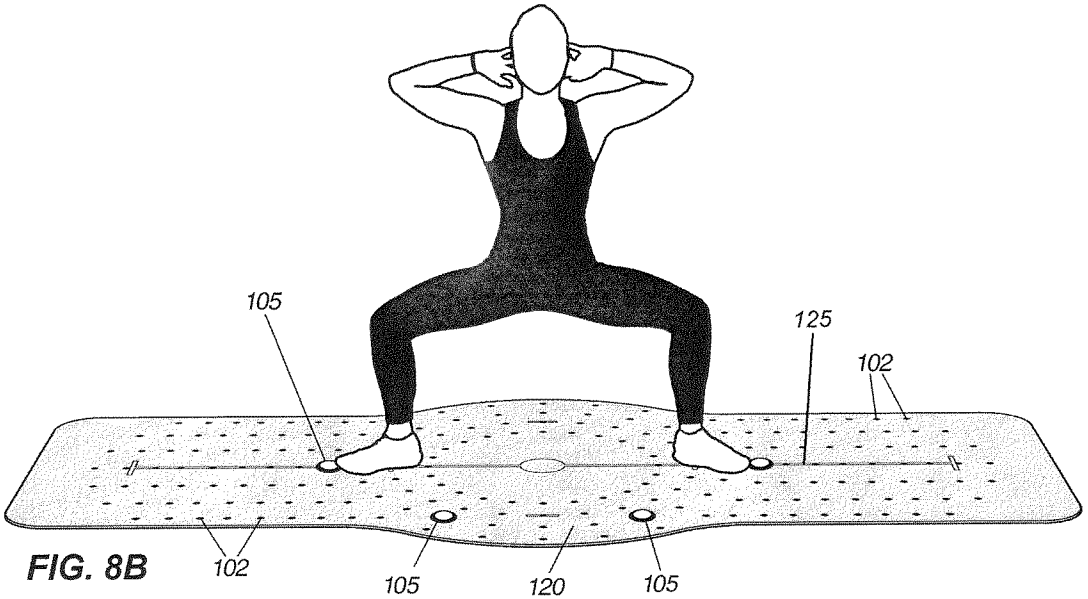
FIGS. 8B and 8C illustrate a person exercising on the mat using the markers as a guide for movement.
Figure 8C:
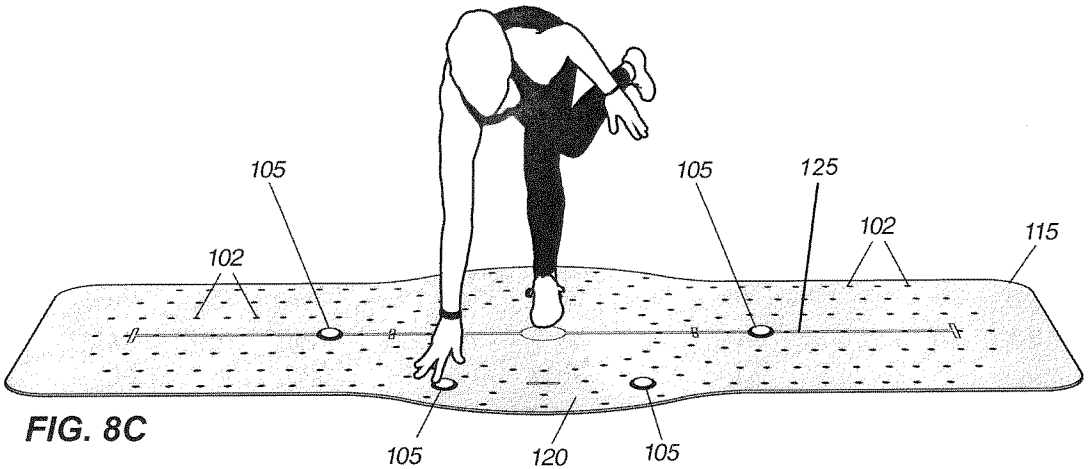

FIG. 8A illustrates a person exercising on the math and using both the central line and markers for proper foot positioning. FIG. 8B illustrates a person standing on the central line 125 adjacent markers 105 of the new shape, expanded central area design of the mat of FIG. 7C, while FIG. 8C illustrates a person standing on the center guide 135 and reaching with her hand to touch one of the markers 105.

Figures 9A, 9B, 9C, 9D, 9E:
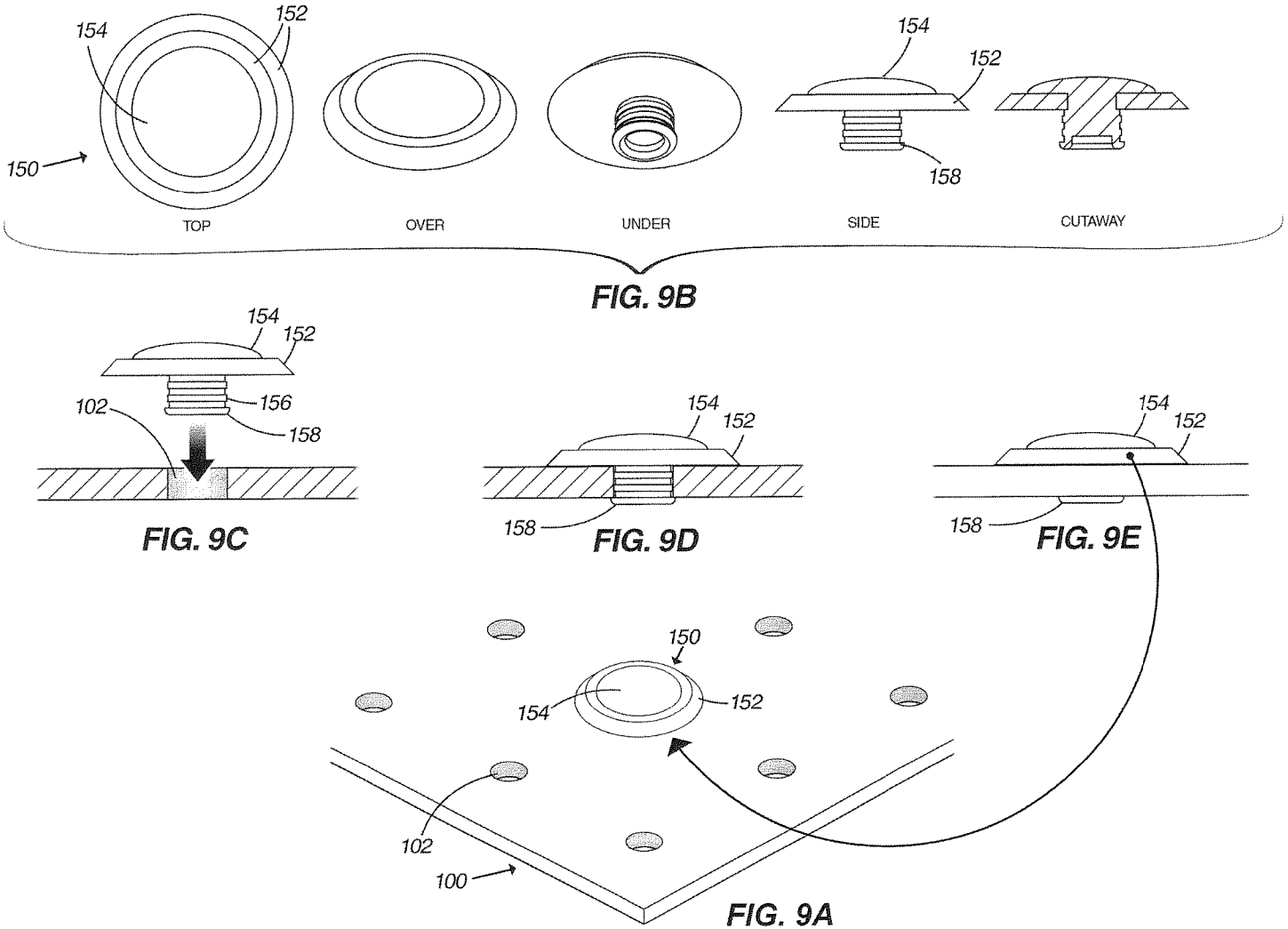
FIGS. 9A-9E to 12A-12E illustrate various marker configurations and their connection to and placement in the mat, with FIGS. 9A, 10A, 11A and 12A illustrating the marker placed in the mat.
Figure 10B:
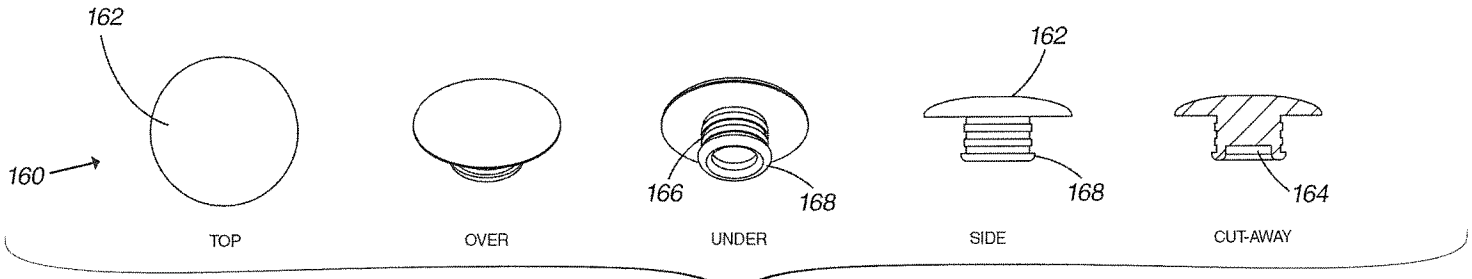
Figure 10C:
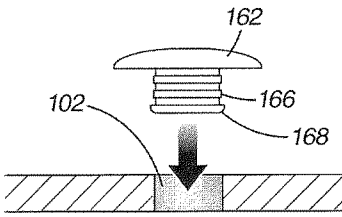
Figure 10D:
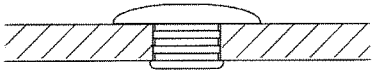
Figure 10E:
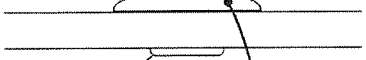
Figure 10A:
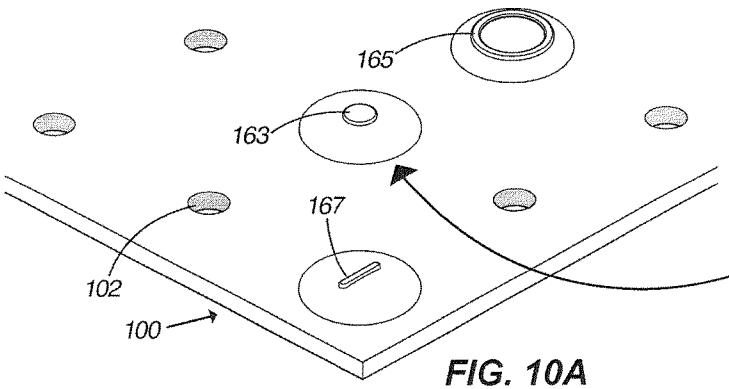

FIGS. 9-12 illustrate a number of different types of markers for use with the mats of the invention. In FIG. 9, the marker 150 has a wider head with an outer ring 152 and inner dome 154. If desired, the dome 154 can be a different color from the ring 152 for greater visibility although they can be the same color in some circumstances. The outer ring can have a flat top portions and sloped side portion although other configurations are possible. The marker 150 has a shaft 156 which is ribbed or can have threads or not but preferably has a wider bottom lip 158 so that the marker shaft 156 can snap into the hole in the mat. FIG. 9 illustrates the configuration of a standard marker which is composed of two parts in order to be made up of two different tones or colors (e.g., black/white; white/red; etc.). This design allows the marker to be more easily seen by user regardless of the color of the mat.

In FIG. 10, the marker 160 has a domed head 162. The domed head 162 has a different color from the mat for greater visibility during use. If desired, the head 162 can be flat to not protrude from the mat. The marker 160 also has a shaft 166 which is ribbed or can have threads or not but preferably has a wider bottom lip 168 so that the marker shaft 166 can snap into the hole in the mat. If desired, the lip 168 can be provided with a cutaway or open portion 164 behind the lip so that the marker can more easily slip through the hole in the mat. As shown, the dome 162 can be provided with a symbol or marking in the form of a circle 163, ring 165, emblem 167, or other indicia. FIG. 10 also shows that the symbol marker can be designed for use by blind users, as they can be able to differentiate the various markers by touch through printed symbols or other indicial on the markers themselves. The symbol or indicia can be an alphanumeric character or a picture or polygon or other item.

Figures 11A, 11B, 11C, 11D, 11E:
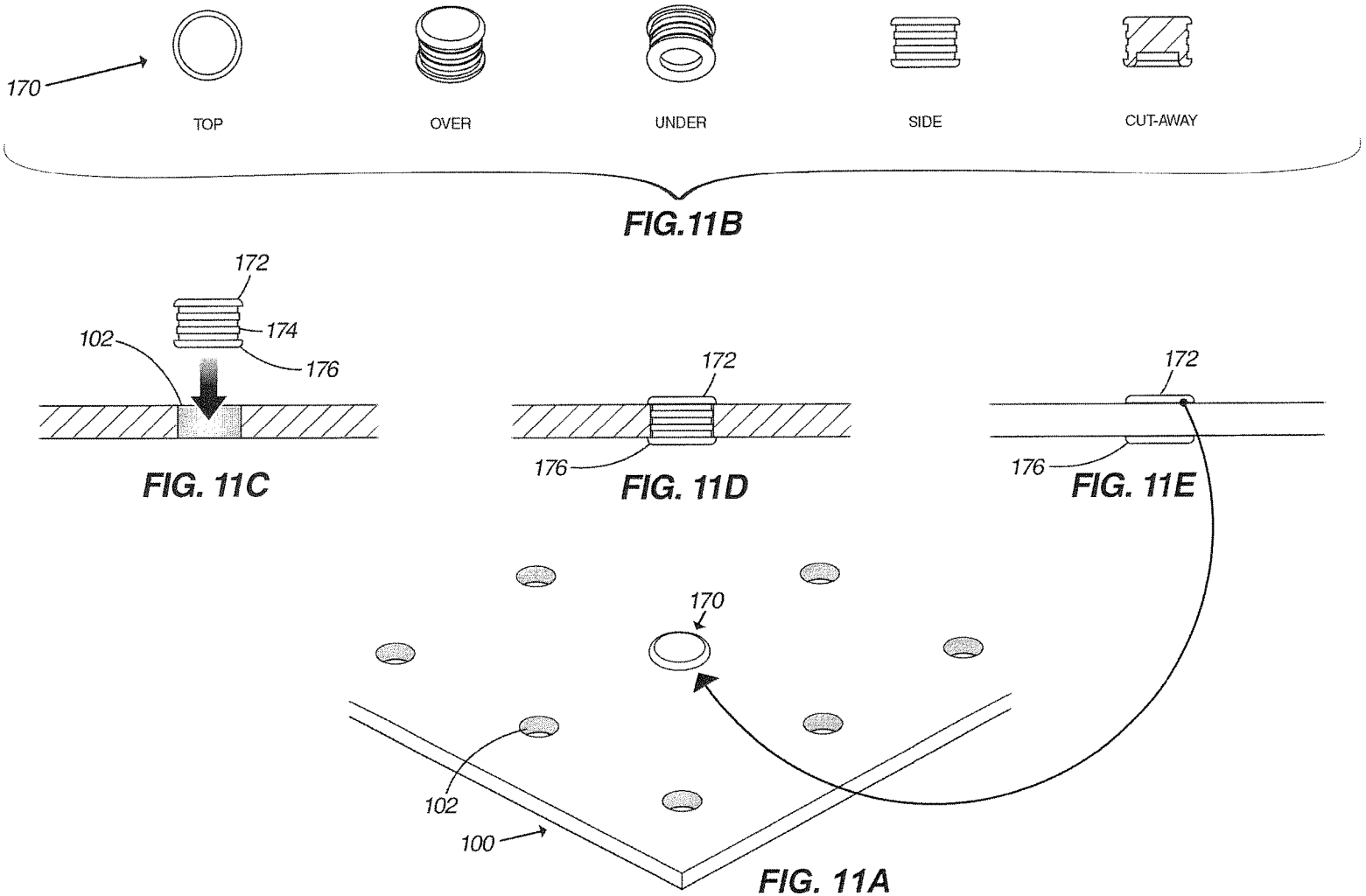

FIG. 11 illustrates another marker 170 having a smaller flat head 172. As in the other embodiments, the head 172 preferably has a ribbed or threaded shaft 174 and an enlarged bottom lip 176 with the cutaway portion 178 behind it. These markers 170 are designed to be used with smaller mats as they provide a minimal marking with a relatively small footprint.

Figures 12A, 12B, 12C, 12D, 12E:
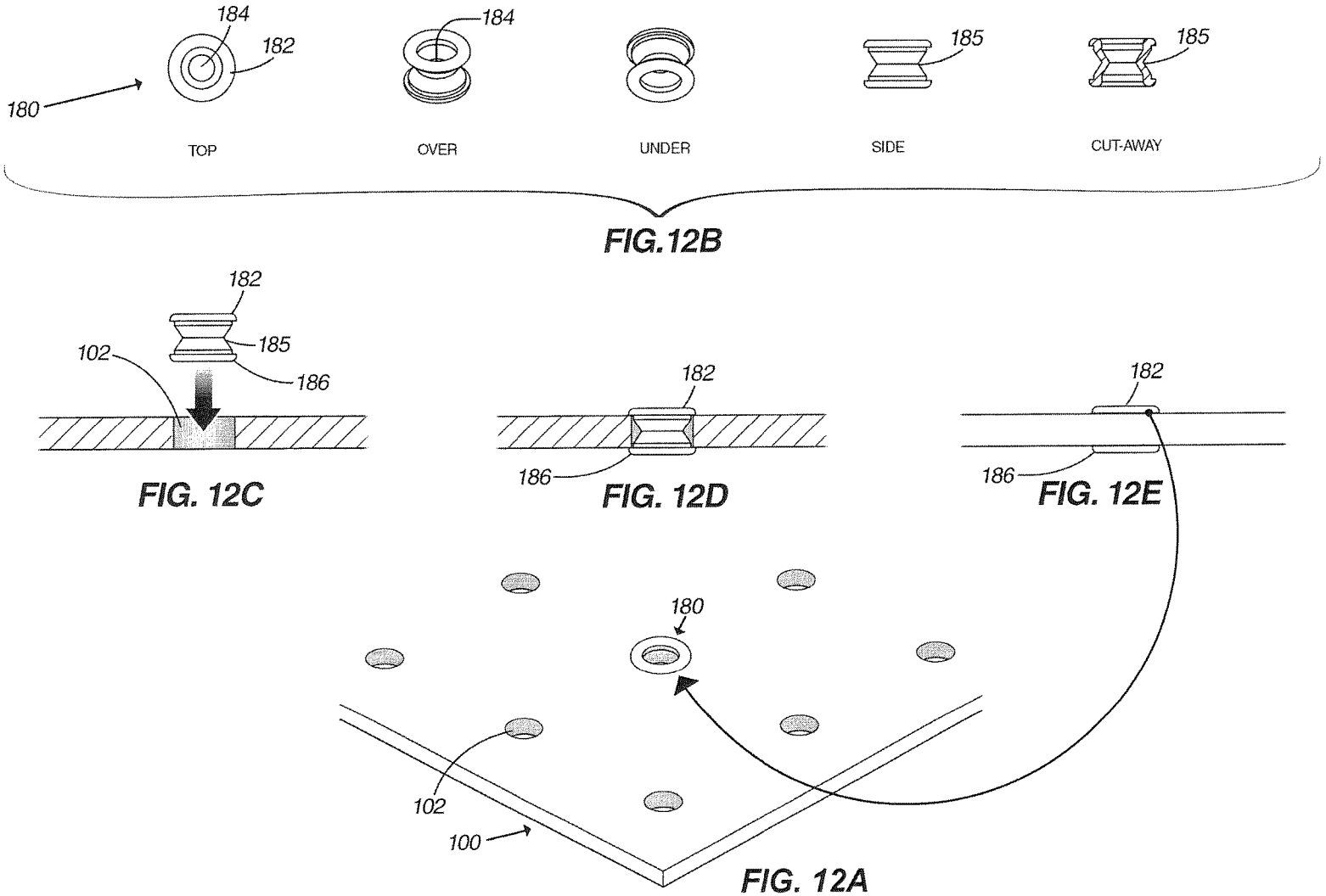

FIG. 12 illustrates yet another embodiment where the marker 180 has an ring top 182 with an opening 184 through its center. The opening 184 can be uniform or can taper from a wider opening and the ring top 182 to a narrower central portion 185 as shown. As in the other embodiments, the marker 180 can have a ribbed or threaded shaft 184 and an enlarged bottom lip 186. The upper opening of the marker 180 appears as a ring on the mat. Of course as noted herein, the markers can be of a different color than the mat to more easily signify the positions of placement of the feet, hands or body of the exercising person. The hollow marker of FIG. 12 also has a minimum footprint but it also is distinguished by also revealing the ground beneath the mat for a further color contrast.

Therefore, in sum, it is to be understood and realized that the optimum dimensional relationships for the parts of the invention to include variations in size, materials, shape, form, function and use are deemed readily apparent and obvious to the skilled artisan, and all equivalent relationships to those illustrated in the drawings and described in the specification are intended to be encompassed by the present invention.

Thus the foregoing is considered as illustrative only of the principles of the invention. Further since numerous modifications and changes will readily be apparent to those having ordinary skill in the art, it is not desired to limit the invention to the exact construction demonstrated.

Accordingly, all suitable modifications and equivalents may be resorted to falling within the scope of the invention. Unless defined otherwise, all technical and scientific terms used herein have same meaning as commonly understood by one of ordinary skill in the art to which this invention belongs.

As used herein and in the appended claims, the singular form "a", "and", and "the" include plural referents unless the context clearly dictates otherwise. All technical and scientific terms used herein have the same meaning.

The publications discussed herein are provided solely for their disclosure prior to the filing date of the present application. All publications, patent applications, patents are incorporated by reference in their entirety to the extent needed. Nothing herein is to be construed as an admission that the present invention is not entitled to be of patentable nature.

What is claimed is:

1. A method of customizing a yoga or exercise mat for use by a particular individual, which comprises providing a yoga or exercise mat comprising:

a body having a longitudinal length, a width and a top surface;

a plurality of holes through the body arranged in a predetermined pattern;

a center line provided on the top surface of the mat;

a plurality of permanent markings located along the center line;

a plurality of markings located off the center line; and markers operatively associated with the holes and utilizing the markings for selecting locations for maintaining proper alignment, correct form, positioning and posture during yoga or exercise, with each marker including a head, a smooth, ribbed or threaded shaft and an enlarged bottom lip that snaps into one of the holes in the mat, so that the individual can apply a number of the markers to the respective body position marking locations provided on the top surface of the mat that conform to the individual's size or shape, wherein the marker is snapped into the hole in the mat from above the top surface of the mat with the enlarged head engaging the bottom of the mat surrounding the opposite end of the hole, such that the individual using the mat can obtain enhanced results during physical activity by associating the markers with the marking locations for maintaining proper alignment, correct form, positioning and posture during yoga or exercise.

2. The method of claim 1, wherein the mat has a widened central area to provide an expanded area for exercising thereon and has rectangular ends, optionally with rounded corners.

3. The method of claim 2, wherein the markers have a wider head with a flat or domed top portion and sloped or arcuate side portions, optionally where the side portions are of a different color from the top portion for greater visibility and wherein the mat has an upper surface constructed of one or more sheets of pliable material of rubber, vinyl, bamboo or a thermoplastic, and an additional surface located beneath the top surface with the second surface manufactured of a rigid material of wood, a thermosetting plastic, metal or carbon fiber.

4. The method of claim 1, wherein at least some of the markers include a handle for grasping by the individual.

5. The method of claim 1, wherein the markers include a message or other indicia thereon that is personalized for the user.

6. The method of claim 1, wherein the body of the mat is provided as a floor area having a longitudinal length, a width and a top surface, and including at least one sub-area providing space for an individual to conduct yoga or other exercises.

7. The method of claim 6, wherein the floor includes a top surface of a pliable and flexible material of plastic, an elastomer or bamboo having a thickness that can effectively absorb shock during exercise.

8. The method of claim 7, wherein the marking locations are provided in a grid-like pattern, the top surface of the floor is substantially planar and includes an alignment guide for positioning of the markers with the marking locations.

9. The method of claim 1, wherein the mat is made of a single layer of a suitable exercise base material and has rectangular ends, optionally with rounded corners, and a widened central area to provide an expanded area for exercising thereon.

10. The method of claim 1, wherein the markers include a ring surrounding the head for providing the marker with a different color than the head.

11. The method of claim 1, wherein the head includes an indicia, emblem, symbol, circle or polygon therein, with the head optionally being of a different color from the indicia, emblem, symbol, circle or polygon.

12. The method of claim 1, wherein the markers include a central opening in the head so that the head appears as a ring when the marker is placed on the mat.

13. The method of claim 1, wherein the body of the mat forms the upper surface of an exercise floor.

* * * * *